US012606769B2

(12) United States Patent
Oliver et al.

(10) Patent No.: US 12,606,769 B2
(45) Date of Patent: Apr. 21, 2026

(54) ANTIOXIDANTS WITH HIGH MONO-ALKYLATED DIPHENYLAMINE CONTENT

(71) Applicant: CHEVRON ORONITE COMPANY LLC, San Ramon, CA (US)

(72) Inventors: Ryan Oliver, Alamo, CA (US); Andrew Michael Thomas, El Sobrante, CA (US); Joanne Liu, Richmond, CA (US)

(73) Assignee: CHEVRON ORONITE COMPANY LLC, San Ramon, CA (US)

( * ) Notice: Subject to any disclaimer, the term of this patent is extended or adjusted under 35 U.S.C. 154(b) by 0 days.

(21) Appl. No.: 16/820,788

(22) Filed: Mar. 17, 2020

(65) Prior Publication Data

US 2020/0299605 A1 Sep. 24, 2020

Related U.S. Application Data

(60) Provisional application No. 62/822,169, filed on Mar. 22, 2019.

(51) Int. Cl.
*C10M 141/12* (2006.01)
*C10M 129/14* (2006.01)
(Continued)

(52) U.S. Cl.
CPC ..... *C10M 141/12* (2013.01); *C10M 129/14* (2013.01); *C10M 133/12* (2013.01);
(Continued)

(58) Field of Classification Search
CPC ..... C10M 141/12; C10M 133/12; C10M 139/00; C10M 135/18; C10M 133/44;
(Continued)

(56) References Cited

U.S. PATENT DOCUMENTS 2,592,428 A 4/1952 Kemp et al.
2,814,655 A 11/1957 Langlois et al.
(Continued)

FOREIGN PATENT DOCUMENTS

CN 101245281 A 8/2008
CN 101687766 3/2010
(Continued)

OTHER PUBLICATIONS

Zhang, S.W., et al.; "Study on Antioxidative Synergism of Molybdenum Dialkydithiocarbamate with Alkylated Diphenylamine Antioxidants"; (Sep. 2008), Journal of ASTM International, vol. 5, No. 10, pp. JAI101814, 1-11.
(Continued)

*Primary Examiner* — Vishal V Vasisth

(57) ABSTRACT

Lubricating oil composition is provided. The composition includes several components including a major amount of a base oil, a mixture of alkylated diphenylamines having a weight ratio of mono-alkylated diphenylamine to di-alkylated diphenylamine ranging from 0.6 to 4.0, and a molybdenum or sulfur additive that provides synergistic enhancement of oxidation stability in combination with the mixture of alkylated diphenylamines.

16 Claims, 1 Drawing Sheet

(51) Int. Cl.

| | |
|---|---|
| ***C10M 133/12*** | (2006.01) |
| ***C10M 133/44*** | (2006.01) |
| ***C10M 135/02*** | (2006.01) |
| ***C10M 135/18*** | (2006.01) |
| ***C10M 139/00*** | (2006.01) |
| ***C10M 141/08*** | (2006.01) |
| ***C10M 169/04*** | (2006.01) |
| *C10N 30/00* | (2006.01) |
| *C10N 30/04* | (2006.01) |
| *C10N 30/10* | (2006.01) |

(52) U.S. Cl.
CPC ..... *C10M 133/44* (2013.01); *C10M 135/02* (2013.01); *C10M 135/18* (2013.01); *C10M 139/00* (2013.01); *C10M 141/08* (2013.01); *C10M 169/04* (2013.01); *C10M 2207/024* (2013.01); *C10M 2215/067* (2013.01); *C10M 2215/223* (2013.01); *C10M 2219/02* (2013.01); *C10M 2219/066* (2013.01); *C10M 2227/00* (2013.01); *C10M 2227/09* (2013.01); *C10N 2030/04* (2013.01); *C10N 2030/10* (2013.01); *C10N 2030/45* (2020.05)

(58) Field of Classification Search
CPC ..... C10M 135/02; C10M 169/04; C10M 141/08; C10M 129/14; C10N 2030/10
See application file for complete search history.

(56) References Cited

U.S. PATENT DOCUMENTS

| | | | | |
|---|---|---|---|---|
| 3,452,056 | A | 6/1969 | Sundholm | |
| 3,498,915 | A | 3/1970 | Coleman | |
| 3,887,634 | A | 6/1975 | Hughes | |
| 5,650,381 | A | 7/1997 | Gatto et al. | |
| 5,672,752 | A * | 9/1997 | Lai | C09K 15/18 564/409 |
| 6,355,839 | B1 | 3/2002 | Onopchenko | |
| 8,426,608 | B2 | 4/2013 | Nelson et al. | |
| 8,476,460 | B2 | 7/2013 | Nelson et al. | |
| 2004/0211113 | A1 * | 10/2004 | Duyck | C10L 1/223 44/426 |
| 2008/0318815 | A1 | 12/2008 | Cherpeck | |
| 2010/0173811 | A1 | 7/2010 | Arrowsmith et al. | |
| 2010/0286004 | A1 | 11/2010 | Gatto et al. | |
| 2015/0087568 | A1 | 3/2015 | Chase et al. | |

FOREIGN PATENT DOCUMENTS

| | | | | |
|---|---|---|---|---|
| EP | 0892037 | | 1/1999 | |
| EP | 2155657 | B1 * | 5/2017 | C07C 209/68 |
| JP | 3567279 | B2 | 9/2004 | |
| JP | 5414649 | B2 | 2/2014 | |
| WO | 2008154334 | | 12/2008 | |
| WO | 2016014380 | | 1/2016 | |

OTHER PUBLICATIONS

Chinese Office Action, issued on Jan. 1, 2023, during the prosecution of Chinese Application No. 202080026021.4.
Singapore Search Report, issued on Sep. 16, 2022, during the prosecution of Singapore Application No. 11202110038Q.
Singapore Written Opinion, issued on Sep. 19, 2022, during the prosecution of Singapore Application No. 11202110038Q.
Cibulkova, Zuzana, et al.; "DSC Study of Stabilizing Effect of Antioxidant Mixtures in Styrene-Butadiene Rubber"; (2012), Journal of Thermal Analysis and Calorimetry, vol. 108, No. 2, pp. 415-419.
Gatto, Vincent J., et al.; "Redesigning Alkylated Diphenylamine Antioxidants for Modern Lubricants"; Lubrication Science 2007, vol. 19, pp. 25-40.
International Search Report, issued on Jul. 3, 2020, during the prosecution of International Application No. PCT/IB2020/052411.
Written Opinion of the International Searching Authority, issued on Jul. 3, 2020, during the prosecution of International Application No. PCT/IB2020/052411.

* cited by examiner

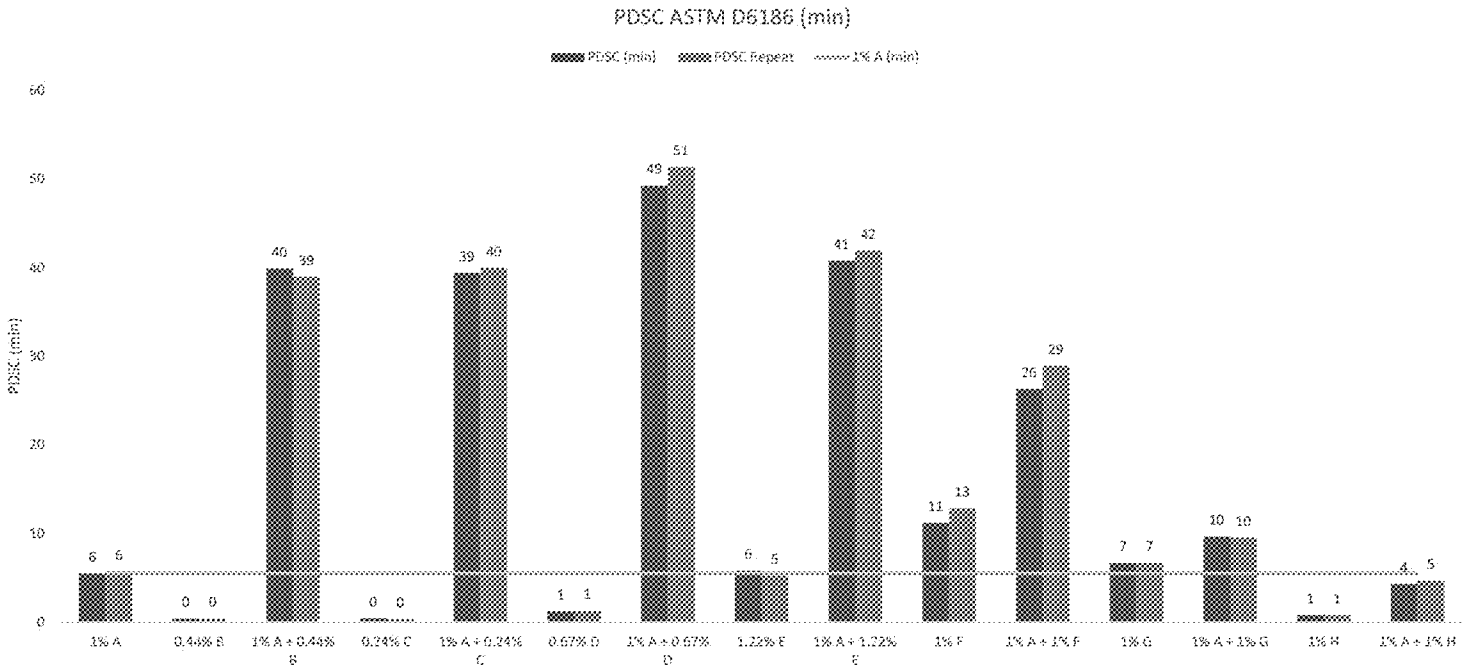
PDSC ASTM D6186 (min)
PDSC (min)
PDSC Repeat
1% A (min)
PDSC (min)
60
50
40
30
20
10
0
6 6
0 0
40 38
0 0
39 40
1 1
49 51
6 5
41 42
11 13
26 29
7 7
10 10
1 1
4 5
1% A
0.44% B
1% A + 0.44%
0.24% C
1% A + 0.24%
0.67% D
1% A + 0.67%
1.22% E
1% A + 1.22%
1% F
1% A + 1% F
1% G
1% A + 1% G
1% H
1% A + 1% H
B
C
D
E

ANTIOXIDANTS WITH HIGH MONO-ALKYLATED DIPHENYLAMINE CONTENT

TECHNICAL FIELD

This disclosure relates to antioxidant additive compositions. More particularly, this disclosure describes alkylated diphenylamine antioxidant compositions having high mono-alkylation content. This application claims benefit of U.S. Provisional Application No. 62/822,169, filed Mar. 22, 2019, which is hereby incorporated herein by reference in its entirety

BACKGROUND

Alkylated diarylamines, such as alkylated diphenylamines, are commonly used as stabilizers or antioxidants in a wide variety of organic materials, including mineral oil derived lubricants and synthetic lubricants. Manufacture of alkylated diphenylamines usually targets higher ratios of di-alkylated diphenylamine to mono-alkylated diphenylamine. For example, industrial preparation of alkylated diphenylamine typically results in about 65-75% by weight of di-alkylated diphenylamine, 20-30% by weight of mono-alkylated diphenylamine, and 5% or less by weight of tri-alkylated diphenylamine. Conventional wisdom is that di- or tri-alkylated diphenylamines have superior oxidation stability compared to mono-alkylated diphenylamines. It is common for alkylated diphenylamines to be made by using relatively lighter olefin oligomers (e.g., C9 oligomers) as alkylating starting material. However, there are safety concerns with these lighter olefin oligomers due to their lower flash point and volatility.

SUMMARY

This disclosure relates to antioxidant additive compositions. More particularly, this disclosure describes alkylated diphenylamine antioxidant compositions having high mono-alkylation content.

In one aspect, there is provided a lubricating oil composition comprising: a major amount of a base oil; and a minor amount of an antioxidant composition comprising: a mixture of alkylated diphenylamines having a weight ratio of mono-alkylated diphenylamine to di-alkylated diphenylamine ranging from 0.6 to 4.0; and a molybdenum or sulfur additive that provides synergistic enhancement of oxidation stability in combination with the mixture of alkylated diphenylamines.

In a further aspect, there is provided an oxidation stabilizing composition comprising: a mixture of alkylated diphenylamines having a weight ratio of mono-alkylated diphenylamine to di-alkylated diphenylamine ranging from 0.6 to 4.0; a molybdenum or sulfur additive that provides synergistic enhancement of oxidation stability in combination with the mixture of alkylated diphenylamines.

In yet a further aspect, there is provided a method of improving oxidation stability of a lubricating oil, the method comprising: supplying to the engine a lubricating oil composition comprising: a major amount of a base oil; a mixture of alkylated diphenylamines having a weight ratio of mono-alkylated diphenylamine to di-alkylated diphenylamine ranging from 0.6 to 4.0; and a molybdenum or sulfur additive that provides synergistic enhancement of oxidation stability in combination with the mixture of alkylated diphenylamines.

BRIEF DESCRIPTION OF THE DRAWINGS

FIG. 1 shows a graphical representation of Pressurized Differential Scanning calorimetry (PDSC) measurements summarized in Table 1 in the Examples.

DETAILED DESCRIPTION

In this specification, the following words and expressions, if and when used, have the meanings ascribed below.

The term "antioxidant" or "oxidation inhibitor" or equivalent term (e.g., "oxidation stabilizer") refers to a composition and its ability to resist deleterious attacks in an oxidizing environment. Antioxidants are often used in organic fluids (e.g., lubricating oil, gear oil, mineral oil, hydraulic fluid, etc.) to improve the oxidation stability of the organic fluid.

The term "mono-alkylated diphenylamine" refers to a diphenylamine that has been alkylated at a single site on one of the two aromatic rings. Mono-alkylation typically occurs at a para site.

The term "di-alkylated diphenylamine" refers to diphenylamine that has been alkylated at two sites on the aromatic ring(s). Di-alkylation typically occurs at two para sites or at a para site and an ortho site.

The term "tri-alkylated diphenylamine" refers to diphenylamine that has been alkylated at three sites on the aromatic ring(s). Tri-alkylation typically occurs at two para sites and a single ortho site.

The term "alkyl" or related term refer to saturated hydrocarbon groups, which can be linear, branched, cyclic, or a combination of cyclic, linear and/or branched.

A "minor amount" or related term means less than 50 wt % of a composition, expressed in respect of the stated additive and in respect of the total weight of the composition, reckoned as active ingredient of the additive.

A "major amount" or related term means an amount greater than 50 wt % based on the total weight of the composition.

Antioxidant

The present invention provides an effective antioxidant composition that can be added to an organic fluid (e.g., mineral oil, hydraulic fluid, metal working fluid, gear oil, etc.) to impart stability to the organic fluid in an oxidizing environment. It has been unexpectedly discovered that an antioxidant composition comprising a mixture containing high mono-alkylated diphenylamine content can be admixed with an organic additive (a molybdenum or sulfur compound) to achieve synergistic enhancement of oxidation stability.

More particularly, the antioxidant composition of the present invention includes (i) weight ratios (i.e., 0.6 to 4.0) of mono-alkylated diphenylamine to di-alkylated diphenylamine and (ii) one or more molybdenum- or sulfur-based organic compounds that provides synergistic enhancement of oxidation stability. The present invention advantageously utilizes olefin oligomers such as propylene tetramers which have higher flash point (62° C.) and are less volatile compared to commercial lighter olefin oligomers. Other advantages will be apparent from the disclosure herein.

Structure 1 shows a chemical structure of diphenylamine which can be used as a starting material in the production of alkylated diphenylamine.

Structure 1

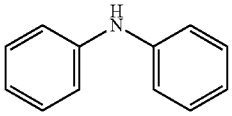

The alkylated diphenylamine of the present invention can be formed by alkylating a diphenylamine with a heavier propylene oligomer such as a propylene tetramer. Any alkylation process compatible with the present invention may be used. For example, U.S. Pat. No. 6,355,839, hereby incorporated by reference, describes the preparation of alkylated diphenylamine wherein the diphenylamine is alkylated with polyisobutylene.

The propylene oligomer can react with diphenylamine in the presence of a clay catalyst. Temperature of this reaction can range from 140° C. to 200° C., more typically between 150° C. to 190° C. In some embodiments, the temperature of the reaction ranges between 160° C. to 180° C. The reaction can be carried out at a single temperature, or sequentially, at different temperatures. The propylene oligomer is charged at a charge mole ratio (CMR) between 2:1 to 8:1 in relation to the diphenylamine charge. In some embodiments, the CMR is between 3:1 to 7:1 or between 4:1 and 6:1. The reaction product can be filtered to remove the catalyst and then distilled to remove unreacted olefin oligomers and diphenylamines.

The use of clay as catalyst in the alkylation of diphenylamine is disclosed in U.S. Pat. No. 3,452,056, the relevant portions of which are hereby incorporated by reference.

As would be expected to a person of ordinary skill in the art, the reaction conditions may vary significantly depending on the catalyst used. For example, reactions involving homogeneous acid catalysts may only require temperatures ranging between 75° C. to 100° C.

In accordance with the present invention, target content of the antioxidant includes about 40 to 80% by weight of mono-alkylated diphenylamine and 20 to 60% by weight of di-alkylated diphenylamine. In some embodiments, the target content is 45 to 75% by weight of mono-alkylated diphenylamine and 25 to 55% by weight of di-alkylated diphenylamine. In some embodiments, the target content is 50 to 70% by weight of mono-alkylated diphenylamine and 30 to 50% by weight of di-alkylated diphenylamine. In some embodiments, the target content is 55 to 65% by weight of mono-alkylated diphenylamine and 35 to 45% by weight of di-alkylated diphenylamine. In some embodiments, tri-alkylated diphenylamine is present in about 5% or less by weight.

It may be economically advantageous to produce antioxidant compositions that target higher mono-alkylated diphenylamine content as mono-alkylated diphenylamines require shorter reaction times compared to di-alkylated diphenylamines. Typically, alkylation reaction times are on the order of several hours. The time required to reach 50% mono-alkylated diphenylamine and 50% di-alkylated diphenylamine can be 3× shorter than the time needed to reach >60% di-alkylated diphenylamine.

Propylene Oligomer

As alluded to earlier, the alkylated diphenylamine can be prepared by alkylating diphenylamines with propylene oligomers. In accordance with the present invention, the alkylation is performed with a propylene oligomer such as a propylene tetramer, which has a higher flash point than propylene C9 oligomers.

The propylene tetramer comprises carbon chains with a high degree of methyl branching and an average carbon number of 12. Generally, propylene tetramer can have a carbon number distribution between 10 to 15 carbon atoms. The tetramer imparts oil solubility and compatibility with other oil soluble lubricant additive components. A tetramer is also a cost effective olefin to manufacture.

In one embodiment, the propylene oligomers contain a distribution of carbon atoms that comprise at least 50 wt % of $C_{10}$ to $C_{15}$ carbon atoms. In one embodiment, the propylene oligomers can contain a distribution of carbon atoms that comprise at least 60 wt % of $C_{10}$ to $C_{15}$ carbon atoms. In one embodiment, the propylene oligomers contain a distribution of carbon atoms that comprise at least 70 wt % of $C_{10}$ to $C_{15}$ carbon atoms. In one embodiment, the propylene oligomers contain a distribution of carbon atoms that comprise at least 80 wt % of $C_{10}$ to $C_{15}$ carbon atoms. In one embodiment, the propylene oligomers contain a distribution of carbon atoms that comprise at least 90 wt % of $C_{10}$ to $C_{15}$ carbon atoms.

As will be apparent to a person of ordinary skill in the art, the propylene oligomers employed herein may also contain lower molecular weight propylene oligomer(s) such as propylene trimer, or higher molecular weight propylene oligomer(s) such as propylene pentamer. In one embodiment, the propylene oligomer is a mixture of olefinic hydrocarbons containing predominately of <1 wt % $C_9H_{18}$, 0-5 wt % $C_{10}H_{20}$, 0-10 wt % $C_{11}H_{22}$, 50-90 wt % $C_{12}H_{24}$, 10-20 wt % $C_{13}H_{26}$, 5-15 wt % $C_{14}H_{28}$, and/or 1-10 wt % $C_{15}H_{30}$.

Alkylation using propylene tetramer will generally result in an alkylated diphenylamine having alkyl group(s) that falls within these parameters. It should be apparent that for a given di- or tri-alkylated diphenylamine molecule, the two or more alkylated alkyl groups may be identical or different in accordance with this disclosure.

The propylene oligomers can be prepared by any method known in the art. For example, one compatible process for preparing the propylene oligomers employs a liquid phosphoric acid oligomerization catalyst. A description of this liquid phosphoric acid-catalyzed propylene oligomerization processes can be found in U.S. Pat. Nos. 2,592,428; 2,814,655; and 3,887,634, the relevant portions of which are hereby incorporated by reference.

The antioxidant composition of the present invention includes a mixture of alkylated diphenylamine with a relatively high weight ratio of mono-alkylated diphenylamine to di-alkylated diphenylamine. This ratio is between about 0.6 to 4.0 which is higher than conventional alkylated diphenylamine antioxidant mixtures (typically around 0.5 or less). In some embodiments, the weight ratio is between 0.7 and 3 or between 0.8 and 2, or between 0.8 and 1.2, or between 0.9 and 1.1. When admixed with an appropriate additive (molybdenum and/or sulfur based composition) in accordance with the present invention, the mixture provides synergistic enhancement of oxidation stability.

Molybdenum Compositions

Molybdenum compositions for use in the present invention are generally organomolybdenum compounds including sulfur-free compounds, phosphorus-free compounds, and sulfur-containing compounds. Synthesis methods for organomolybdenum compounds are generally known. Many organomolybdenum compounds are commercially available.

Examples of sulfur- and phosphorus-free organomolybdenum compounds include molybdenum trioxide, ammonium molybdate, sodium molybdate and potassium molybdate. The alcohol groups may be mono-substituted alcohols, diols, or bis-alcohols, or polyalcohols.

Other suitable organomolybdenum compounds include, but are not limited to, molybdenum succinimide, molybdenum amino alcohol, and the like. The amino groups may be monoamines, diamines, or polyamines.

Still other suitable molybdenum compositions include those listed in U.S. Pat. No. 8,426,608, hereby incorporated by reference. Readily available molybdenum compositions include molybdenum di(2-ethylhexyl) phosophorodithioate which is commercially available under tradename Molyvan® L (Vanderbilt Chemicals), molybdenum dialkyldithiocarbamate which is commercially available under tradename Molyvan® 807 (Vanderbilt Chemicals), molybdenum dialkyldithiocarbamate which is commercially available under tradename Molyvan® 822 (Vanderbilt Chemicals), molybdenum ester/amide which is commercially available under tradename Molyvan® 855 (Vanderbilt Chemicals), molybdenum dithiocarbamate which is commercially available under tradename Molyvan® 3000 (Vanderbilt Chemicals), molybdenum dithiocarbamate which is commercially available under tradename Sakura-Lube® 200 (Adeka), molybdenum dithiocarbamate which is commercially available under tradename Sakura-Lube® 165 (Adeka), molybdenum dithiocarbamate which is commercially available under tradename Sakura-Lube® 525 (Adeka), molybdenum dithiocarbamate which is commercially available under tradename Sakura-Lube® 600 (Adeka), molybdenum dithiophosphate which is commercially available under tradename Sakura-Lube® 300 (Adeka), molybdenum dithiophosphate which is commercially available under tradename Sakura-Lube® 310G (Adeka), molybdenum-amine complex which is commercially available under tradename Sakura-Lube® 700 (Adeka), and organic molybdenum compound which is commercially available under tradename Sakura-Lube® 710 (Adeka).

Sulfur Compositions

Suitable sulfur compositions are generally organosulfur compounds including sulfurized olefin ester, sulfurized isobutylene, methylene bisdithiocarbamate, sulfur-containing phenols, thioester bis hydrocinnamic ester, and the like.

Readily available sulfur compositions include trisulfide sulfur donor which is commercially available under tradename TPS® 20 (Arkema), pentasulfide sulfur donor which is commercially available under tradename TPS® 32 (Arkema), 4,4'-methylene bis(dibutyldithiocarbamate) which is commercially available under tradename Vanlube® 7723 (Vanderbilt Chemicals), methylene bis(dibutyldithiocarbamate) which is commercially available under tradename Vanlube® 996E (Vanderbilt Chemicals), dithiocarbamate which is commercially available under tradename NA-Lube® ADTC (King Industries), phosphorus-sulfur containing additive which is commercially available under tradename NA-Lube® AW-6330 (King Industries), sulfurized hydrocarbon which is commercially available under tradename Elco 213 (Elco Corporation), sulfurized hydrocarbon which is commercially available under tradename Elco 226 (Elco Corporation), sulfurized ester which is commercially available under tradename Elco 2556 (Elco Corporation), sulfurized ester which is commercially available under tradename Elco 2410SE (Elco Corporation), sulfurized ester which is commercially available under tradename Elco 2415C (Elco Corporation), sulfurized fatty acid which is commercially available under tradename Elco 2418 (Elco Corporation), sulfurized ester which is commercially available under tradename Elco 2426C (Elco Corporation), sulfurized ester which is commercially available under tradename Elco 2430C (Elco Corporation), sulfurized vegetable oil which is commercially available under tradename Elco 2451 (Elco Corporation), sulfurized vegetable oil which is commercially available under tradename Elco 2452 (Elco Corporation), sulfurized vegetable oil which is commercially available under tradename Elco 2452D (Elco Corporation), sulfurized ester which is commercially available under tradename Elco 2456 (Elco Corporation), sulfurized ester which is commercially available under tradename Elco 2456D (Elco Corporation), sulfurized isobutylene which is commercially available under tradename C-TEC 321 (Tianhe Chemicals) and sulfur-containing phenols which is commercially available under tradename Songnox® 1035 (Songwon).

Certain compatible additives can contain both molybdenum and sulfur. Examples of these include molybdenum dithiolcarbamate (DTC) and molybdenum dithiophosphate (DTP).

Lubricating Oil Compositions

The antioxidant compositions of present disclosure may be used in lubricating oil to impart oxidation stability to the lubricating oil. When employed in this manner, the mixture of alkylated diphenylamines are usually present in the lubricating oil composition in concentrations ranging from 0.05 wt % to 10 wt % (including, but not limited to, 0.1 to 5 wt %, 0.2 to 4 wt %, 0.5 to 3 wt %, 1 to 2 wt %, and so forth), based on the total weight of the lubricating oil composition. If other antioxidants are present in the lubricating oil composition, a lesser amount of the antioxidant of the present invention may be used.

The molybdenum content of the molybdenum composition can vary from about 1-10,000 ppm, 10 to 9,000 ppm, 100 to 8,000 ppm, 500 to 7,000 ppm, 1,000 to 5,000 ppm, or 2,000 to 4,000 ppm. The molybdenum composition can be present in about 0.05 wt % to 10 wt %, 0.1 wt % to 9 wt %, 1 wt % to 8 wt %, 2 wt % to 6 wt %, or 3 wt % to 5 wt %. The concentration of the sulfur composition can range from about 0.05 wt % to about 40 wt %, 0.5 wt % to about 30 wt %, 1 wt % to 25 wt %, or 5 wt % to 20 wt % of the antioxidant composition. Oils used as the base oil will be selected or blended depending on the desired end use and the additives in the finished oil to give the desired grade of engine oil, e.g. a lubricating oil composition having an Society of Automotive Engineers (SAE) Viscosity Grade of 0W, 0W-8, 0W-16, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, or 15W-40.

The oil of lubricating viscosity (sometimes referred to as "base stock" or "base oil") is the primary liquid constituent of a lubricant, into which additives and possibly other oils are blended, for example to produce a final lubricant (or lubricant composition). A base oil, which is useful for making concentrates as well as for making lubricating oil compositions therefrom, may be selected from natural (vegetable, animal or mineral) and synthetic lubricating oils and mixtures thereof.

Definitions for the base stocks and base oils in this disclosure are the same as those found in American Petroleum Institute (API) Publication 1509 Annex E ("API Base Oil Interchangeability Guidelines for Passenger Car Motor Oils and Diesel Engine Oils," December 2016). Group I base stocks contain less than 90% saturates and/or greater than 0.03% sulfur and have a viscosity index greater than or equal to 80 and less than 120 using the test methods specified in Table E-1. Group II base stocks contain greater than or equal to 90% saturates and less than or equal to 0.03% sulfur and have a viscosity index greater than or equal to 80 and less than 120 using the test methods specified in Table E-1. Group III base stocks contain greater than or equal to 90% saturates and less than or equal to 0.03% sulfur and have a viscosity index greater than or equal to 120 using the test methods specified in Table E-1. Group IV base stocks are polyalphaolefins (PAO). Group V base stocks include all other base stocks not included in Group I, II, III, or IV.

Natural oils include animal oils, vegetable oils (e.g., castor oil and lard oil), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Synthetic oils include hydrocarbon oil. Hydrocarbon oils include oils such as polymerized and interpolymerized olefins (e.g., polybutylenes, polypropylenes, propylene isobutylene copolymers, ethylene-olefin copolymers, and ethylene-alphaolefin copolymers). Polyalphaolefin (PAO) oil base stocks are commonly used synthetic hydrocarbon oil. By way of example, PAOs derived from $C_8$ to $C_{14}$ olefins, e.g., $C_8$, $C_{10}$, $C_{12}$, $C_{14}$ olefins or mixtures thereof, may be utilized.

Other useful fluids for use as base oils include non-conventional or unconventional base stocks that have been processed, preferably catalytically, or synthesized to provide high performance characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

Base oils for use in the lubricating oil compositions of present disclosure are any of the variety of oils corresponding to API Group I, Group II, Group III, Group IV, and Group V oils, and mixtures thereof, preferably API Group II, Group III, Group IV, and Group V oils, and mixtures thereof, more preferably the Group III to Group V base oils due to their exceptional volatility, stability, viscometric and cleanliness features.

Typically, the base oil will have a kinematic viscosity at 100° C. (ASTM D445) in a range of 2.5 to 20 $mm^2/s$ (e.g., 3 to 12 $mm^2/s$, 4 to 10 $mm^2/s$, or 4.5 to 8 $mm^2/s$).

The present lubricating oil compositions may also contain conventional lubricant additives for imparting auxiliary functions to give a finished lubricating oil composition in which these additives are dispersed or dissolved. For example, the lubricating oil compositions can be blended with antioxidants, ashless dispersants, anti-wear agents, detergents such as metal detergents, rust inhibitors, dehazing agents, demulsifying agents, friction modifiers, metal deactivating agents, pour point depressants, viscosity modifiers, antifoaming agents, co-solvents, package compatibilizers, corrosion-inhibitors, dyes, extreme pressure agents and the like and mixtures thereof. A variety of the additives are known and commercially available. These additives, or their analogous compounds, can be employed for the preparation of the lubricating oil compositions of the invention by the usual blending procedures.

Each of the foregoing additives, when used, is used at a functionally effective amount to impart the desired properties to the lubricant. Thus, for example, if an additive is an ashless dispersant, a functionally effective amount of this ashless dispersant would be an amount sufficient to impart the desired dispersancy characteristics to the lubricant. Generally, the concentration of each of these additives, when used, may range, unless otherwise specified, from about 0.001 to about 20 wt %, such as about 0.01 to about 10 wt %.

The following illustrative examples are intended to be non-limiting.

Examples 1-15

Oxidation stability of antioxidant compositions were evaluated using Pressurized Differential Scanning calorimetry (PDSC) according to ASTM D 6186 test protocol. Greater PDSC times indicated greater oxidation stability. Table 1 summarizes the results for Examples 1-15. Two PDSC runs were performed for each example. FIG. 1 illustrates this data in graphical form.

Each sample contained a major amount of base oil and a minor amount of an antioxidant composition comprising a mixture of mono-alkylated and di-alkylated diphenylamine in 1:1 wt % ratio and/or an additive. The alkylating group is propylene tetramer.

The additives can be categorized into at least 3 groups: molybdenum-based, sulfur-based, or hindered phenolic-based. Certain additives can be categorized in more than one category group.

Example 1 is the PDSC results that show the degree of oxidation stability of composition A which is a mixture of alkylated diphenylamine containing a 1:1 wt % ratio of mono-alkylated (tetrapropenyl) diphenylamine to di-alkylated (tetrapropenyl) diphenylamine. The mixture, which serves as a baseline measurement, is a reaction product of propylene oligomer and diphenylamine. Composition A is present in 1 wt %.

Example 2 is the PDSC results that show the degree of oxidation stability of composition B which is a molybdenum succinimide. Molybdenum succinimide is a reaction product of alkyl or alkenyl succinimide of a polyamine with an acidic molybdenum compound. Details of this reaction can be found in U.S. Pat. No. 8,476,460, the relevant portions of which is hereby incorporated by reference. Antioxidant composition B is present in 0.44 wt %. The molybdenum concentration is 200 ppm.

Example 3 is the PDSC results that show the degree of synergy between compositions A and B. The concentration of A is 1 wt %. The concentration of B is 0.44 wt %.

Example 4 is the PDSC results that show the degree of oxidation stability of antioxidant composition C. Composition C is a molybdenum amino alcohol, commercially available from Vanderbilt Chemicals, LLC (Norwalk, Conn.) under the tradename Molyvan® 855. The concentration of C is 0.24 wt %. The molybdenum concentration is 200 ppm.

Example 5 is the PDSC results that show the degree of synergy between compositions A and C. The concentration of A is 1 wt %. The concentration of B is 0.24 wt %.

Example 6 is the PDSC results that show the degree of oxidation stability of composition D which is an ashless alkyl dithiolcarbamate, commercially available from Vanderbilt Chemicals, LLC (Norwalk, Conn.) under the tradename Vanlube® 7723. The concentration of D is 0.37 wt %. The sulfur concentration is 2000 ppm.

Example 7 is the PDSC results that show the degree of synergy between compositions A and D. The concentration of A is 1 wt %. The concentration of B is 0.37 wt %.

Example 8 is the PDSC results that show the degree of oxidation stability of composition E which is a reaction product butyl-cyclohex-3-enecarboxylate, sulfur, and triphenyl phosphite. This reaction is described in U.S. Pat. No. 3,498,915, which is hereby incorporated by reference. The concentration of E is 0.67 wt %. The sulfur concentration is 2000 ppm.

Example 9 is the PDSC results that show the degree of synergy between compositions A and E. The concentration of A is 1 wt %. The concentration of E is 0.67 wt %.

Example 10 is the PDSC results that show the degree of oxidation stability of composition F. Composition F is a sulfur-containing phenolic antioxidant, commercially available from Songwon (Friendswood, Tex.) under the tradename Songnox® 1035. The concentration of F is 1.22 wt %.

Example 11 is the PDSC results that show the level of synergy between compositions A and F. The concentration of A is 1 wt %. The concentration of F is 1.22 wt %.

Example 12 is the PDSC results that show the degree of oxidation stability of composition G. Composition G is a non-sulfur containing methylenebisphenol antioxidant, commercially available from SI Group (Schenectady, N.Y.) under the tradename Ethanox® 4702. The concentration of G is 0.46 wt %.

Example 13 is the PDSC results that show the level of synergy between compositions A and G. The concentration of A is 1 wt %. The concentration of G is 0.46 wt %.

Example 14 is the PDSC results that show the degree of oxidation stability of composition H. Composition H is a non-sulfur containing benzotriazole substituted phenolic antioxidant, commercially available from Songwon (Friendswood, Tex.) under the tradename Songsorb® 3200. The concentration of H is 1 wt %.

Example 15 is the PDSC results that show the degree of synergy between compositions A and H. The concentration of A is 1 wt %. The concentration of H is 1 wt %.

As shown in Table 1, oxidation stability synergies can be seen between the 1:1 mixture of mono-alkylated diphenylamine and di-alkylated diphenylamine and several additive compositions. These synergistic compositions include 1:1 mixture of mono/di alkylated diphenylamine and molybdenum containing components (Ex. 3 and 5) or sulfur containing components (Ex. 7 and 9). Generally, no synergy was observed between the 1:1 mixture of mono/di alkylated diphenylamine and phenolic antioxidant (Ex. 13 and 15) except when sulfur containing phenolic antioxidant was used (Ex. 11).

TABLE 1

PDSC Results

| | Antioxidant | 1st Run PDSC (minutes) | 2nd Run PDSC (minutes) |
|---|---|---|---|
| Ex. 1 | 1% A | 6 | 6 |
| Ex. 2 | 0.44% B (200 ppm Mo) | 0 | 0 |
| Ex. 3 | 1% A + 0.44% B | 40 | 39 |
| Ex. 4 | 0.24% C (200 ppm Mo) | 0 | 0 |
| Ex. 5 | 1% A + 0.24% C | 39 | 40 |
| Ex. 6 | 0.67% D (2000 ppm S) | 1 | 1 |
| Ex. 7 | 1% A + 0.67% D | 49 | 51 |
| Ex. 8 | 1.22% E (2000 ppm S) | 6 | 5 |
| Ex. 9 | 1% A + 1.22% E | 41 | 42 |
| Ex. 10 | 1% F | 11 | 13 |
| Ex. 11 | 1% A + 1% F | 26 | 29 |
| Ex. 12 | 1% G | 7 | 7 |
| Ex. 13 | 1% A + 1% G | 10 | 10 |
| Ex. 14 | 1% H | 1 | 1 |
| Ex. 15 | 1% A + 1% H | 4 | 5 |

Examples 16-19

Examples 16-18 include samples containing various wt % ratios of diphenylamine alkylated with propylene tetramer. The wt % ratios include 50/50 mixture of mono-alkylated diphenylamine to di-alkylated diphenylamine (Ex. 16), 75/25 mixture of mono-alkylated diphenylamine to di-alkylated diphenylamine (Ex. 17), and 30/70 mixture of mono-alkylated diphenylamine to di-alkylated diphenylamine (Ex. 18).

Examples 19 is a commercial mixture of mono-/di-alkylated diphenylamine contains about 70 wt % of di-alkylated diphenylamine and about 25 wt % of mono-alkylated diphenylamine. The mixture is commercially available under the tradename Irganox® L 67 from BASF (Florham Park, N.J.).

These samples were added to a conventional lubricating oil comprising a major amount of base oil(s) and minor amounts of conventional lubricating oil additives (e.g., viscosity modifier, detergent, dispersant, anti-wear additive, etc.). The samples were evaluated between 0.74 to 0.89 wt % at equivalent nitrogen levels using PDSC following ASTM D6186 protocol. The results are summarized in Table 2 below and show that a high mono-alkylated diphenylamine mixture works as well as or better than a low mono-alkylated diphenylamine mixtures. Moreover, diphenylamine alkylated with propylene tetramer provide greater oxidation stability compared to diphenylamine alkylated with propylene trimer.

TABLE 2

PDSC Results for Alkylated DPA at Equal Nitrogen Content

| | Sample | Alkylation Group | PDSC (minutes) | wt % | Mono/Di Ratio |
|---|---|---|---|---|---|
| Ex. 16 | 50/50 Mixture of mono-/di-alkylated DPA | Propylene Tetramer | 76 | 0.82% | 1 |
| Ex. 17 | 75/25 Mixture of mono-/di-alkylated DPA | Propylene Tetramer | 76 | 0.74% | 3 |
| Ex. 18 | 30/70 Mixture of mono-/di-alkylated DPA | Propylene Tetramer | 72 | 0.89% | 0.4 |
| Ex. 19 | Commercial Mixture of mono-/di-alkylated DPA | Propylene Trimer | 54 | 0.8% | 0.25-0.4 |

The invention claimed is:

1. A lubricating oil composition comprising:
a major amount of a base oil; and
an antioxidant composition comprising:
0.01 wt % to 5 wt % based on the lubricating oil composition of a mixture of alkylated diphenylamines having a weight ratio of mono-alkylated diphenylamine to di-alkylated diphenylamine ranging from 0.8 to 3, wherein the mixture of alkylated diphenylamines is primarily a mixture product of diphenylamine alkylated with propylene tetramer; and
0.01 wt % to 5 wt % based on the lubricating oil composition of a molybdenum or sulfur additive that provides synergistic enhancement of oxidation stability in combination with the mixture of alkylated diphenylamines.

2. The lubricating oil composition of claim 1, wherein the additive is a molybdenum succinimide, molybdenum amino alcohol, molybdenum dithiolcarbamate, sulfurized olefin ester, sulfurized isobutylene, methylene bisdithiocarbamate, molybdenum dialkyldithiocarbamate, molybdenum ester/amide, molybdenum dithiophosphate, molybdenum amine-complex, methylene bis(dibutyldithiocarbamate), sulfurized hydrocarbon, sulfurized ester, sulfurized fatty acid, sulfurized vegetable oil, sulfurized isobutylene, sulfur-containing phenol, or thioester bis-hydrocinnamic ester.

3. The lubricating oil composition of claim 1, wherein the weight ratio of mono-alkylated diphenylamine to di-alkylated diphenylamine ranges from 0.9 to 1.1.

4. The lubricating oil of claim 1, further comprising:
an antioxidant, an ashless dispersant, an anti-wear agent, a detergent, a rust inhibitor, a dehazing agent, a demulsifying agent, a friction modifier, a metal deactivating agent, a pour point depressant, a viscosity modifier, an antifoaming agent, a co-solvent, a package compatibilizer, a corrosion-inhibitor, a dye, or an extreme pressure agent.

5. An oxidation stabilizing composition comprising:
a mixture of alkylated diphenylamines having a weight ratio of mono-alkylated diphenylamine to di-alkylated diphenylamine ranging from 0.8 to 3, wherein the mixture of alkylated diphenylamines is primarily a mixture product of diphenylamine alkylated by propylene tetramer; and
a molybdenum or sulfur additive that provides synergistic enhancement of oxidation stability in combination with the mixture of alkylated diphenylamines.

6. The oxidation stabilizing composition of claim 5, further comprising:
a lubricating oil, a mineral oil, a hydraulic fluid, a metal working fluid, or a gear oil.

7. The oxidation stabilizing composition of claim 5, wherein the additive is a organomolybdenum compound, sulfur-containing organomolybdenum compound, sulfur-free organomolybdenum compound, or a sulfur-containing organic compound.

8. The oxidation stabilizing composition of claim 5, wherein the additive is a molybdenum succinimide, molybdenum amino alcohol, molybdenum dithiolcarbamate, molybdenum dialkyldithiocarbamate, molybdenum ester/amide, molybdenum dithiophosphate, molybdenum amine-complex, sulfurized olefin ester, sulfurized isobutylene, methylene bisdithiocarbamate, methylene bis(dibutyldithiocarbamate), sulfurized hydrocarbon, sulfurized ester, sulfurized fatty acid, sulfurized vegetable oil, sulfurized isobutylene, or thioester bis hydrocinnamic ester.

9. The oxidation stabilizing composition of claim 5, wherein the weight ratio of mono-alkylated diphenylamine to di-alkylated diphenylamine ranges from 0.9 to 1.1.

10. The oxidation stabilizing composition of claim 5, further comprising:
an antioxidant, an ashless dispersant, an anti-wear agent, a detergent, a rust inhibitor, a dehazing agent, a demulsifying agent, a friction modifier, a metal deactivating agent, a pour point depressant, a viscosity modifier, an antifoaming agent, a co-solvent, a package compatibilizer, a corrosion-inhibitor, a dye, or an extreme pressure agent.

11. A method of improving oxidation stability of a lubricating oil, the method comprising:
supplying to the engine a lubricating oil composition comprising:
a major amount of a base oil;
0.01 wt % to 5 wt % based on total lubricating oil composition of a mixture of alkylated diphenylamines having a weight ratio of mono-alkylated diphenylamine to di-alkylated diphenylamine ranging from 0.8 to 3, wherein the mixture of alkylated diphenylamines is primarily a mixture product diphenylamine alkylated by propylene tetramer; and
0.01 wt % to 5 wt % based on total lubricating oil composition of a molybdenum or sulfur additive that provides synergistic enhancement of oxidation stability in combination with the mixture of alkylated diphenylamines.

12. The method of claim 11, wherein the lubricating oil composition further comprises:
an antioxidant, an ashless dispersant, an anti-wear agent, a detergent, a rust inhibitor, a dehazing agent, a demulsifying agent, a friction modifier, a metal deactivating agent, a pour point depressant, a viscosity modifier, an antifoaming agent, a co-solvent, a package compatibilizer, a corrosion-inhibitor, a dye, or an extreme pressure agent.

13. The method of claim 11, wherein the additive is molybdenum succinimide, molybdenum amino alcohol, molybdenum dithiolcarbamate, sulfurized olefin ester, sulfurized isobutylene, methylene bisdithiocarbamate, molybdenum dialkyldithiocarbamate, molybdenum ester/amide, molybdenum dithiophosphate, molybdenum amine-complex, methylene bis(dibutyldithiocarbamate), sulfurized hydrocarbon, sulfurized ester, sulfurized fatty acid, sulfurized vegetable oil, sulfurized isobutylene, or thioester bis hydrocinnamic ester.

14. A lubricating oil composition comprising:
a major amount of a base oil; and
0.01 wt % to 5 wt % based on the lubricating oil composition of an antioxidant comprising a mixture of alkylated diphenylamines having a weight ratio of mono-alkylated diphenylamine to di-alkylated diphenylamine ranging from 0.8 to 3, wherein the alkylated diphenylamines is a product of an alkylation of diphenylamine and propylene tetramer.

15. The lubricating oil of claim 14, further comprising:
an antioxidant, an ashless dispersant, an anti-wear agent, a detergent, a rust inhibitor, a dehazing agent, a demulsifying agent, a friction modifier, a metal deactivating agent, a pour point depressant, a viscosity modifier, an antifoaming agent, a co-solvent, a package compatibilizer, a corrosion-inhibitor, a dye, or an extreme pressure agent.

16. The lubricating oil of claim 14, wherein the weight ratio of mono-alkylated diphenylamine to di-alkylated diphenylamine ranges from 0.9 to 1.1.

* * * * *